US011450198B2

(12) United States Patent
Pedersen et al.

(10) Patent No.: US 11,450,198 B2
(45) Date of Patent: Sep. 20, 2022

(54) MANUAL CALL POINT

(71) Applicant: Carrier Corporation, Palm Beach Gardens, FL (US)

(72) Inventors: Ole Martin Pedersen, Trondheim (NO); Per Johan Vannebo, Trondheim (NO); Geir Tore Olsen, Trondheim (NO)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/109,990

(22) Filed: Dec. 2, 2020

(65) Prior Publication Data

US 2021/0166553 A1 Jun. 3, 2021

(30) Foreign Application Priority Data

Dec. 3, 2019 (EP) ..... 19213175

(51) Int. Cl.
*G08B 25/12* (2006.01)
*G08B 17/02* (2006.01)
*H01H 3/02* (2006.01)

(52) U.S. Cl.
CPC ..... *G08B 25/12* (2013.01); *G08B 17/02* (2013.01); *H01H 3/022* (2013.01); *H01H 2003/0233* (2013.01)

(58) Field of Classification Search
CPC ..... G08B 25/12; G08B 17/02; G08B 29/14; H01H 2003/0233; H02P 29/032; F16H 2716/02
See application file for complete search history.

(56) References Cited

U.S. PATENT DOCUMENTS 3,949,219 A 4/1976 Crouse
5,047,628 A 9/1991 Schmidt et al.
5,233,323 A * 8/1993 Burkett ..... H01H 36/0066 335/205
6,696,987 B1 2/2004 Rychlak
(Continued)

FOREIGN PATENT DOCUMENTS

DE 3908885 C1 5/1990
DE 19504826 C1 8/1996
(Continued)

OTHER PUBLICATIONS

European Search Report for Application No. 19213175.3; dated Jun. 4, 2020; 15 Pages.
(Continued)

*Primary Examiner* — Mirza F Alam
(74) *Attorney, Agent, or Firm* — Cantor Colburn LLP

(57) ABSTRACT

A manual call point for a fire alarm system, the manual call point includes: an operating element 18, wherein a physical movement of the operating element 18 will trigger an alarm condition of the manual call point; at least two switch devices 12, 14, 16. Each switch device 12, 14, 16 is arranged to complete or break a circuit in response to the physical movement of the operating element 18. At least one of the switch devices 12, 14, 16 is a contactless device 12, 14 and the corresponding circuit includes an electromagnetic circuit that is completed or broken without mechanical contact from the operating element 18.

2 Claims, 2 Drawing Sheets

(56) References Cited

U.S. PATENT DOCUMENTS

| | | | | |
|---|---|---|---|---|
| 8,314,714 | B2 | 11/2012 | Pichard et al. | |
| 2003/0206096 | A1* | 11/2003 | Right | G08B 25/12 340/287 |
| 2010/0141365 | A1* | 6/2010 | Edmonson, Jr. | H01H 36/0013 335/207 |
| 2012/0050001 | A1* | 3/2012 | Koether | H04L 12/40045 340/4.3 |
| 2021/0201655 | A1* | 7/2021 | Saunders | G08B 25/12 |

FOREIGN PATENT DOCUMENTS

| | | | | |
|---|---|---|---|---|
| EP | 2871777 | A1 | 5/2015 | |
| GB | 2255232 | A * | 10/1992 | G08B 25/12 |
| WO | 2018015418 | A1 | 1/2018 | |

OTHER PUBLICATIONS

European Search Report for Application No. 19213175.3; dated Sep. 18, 2020; 15 Pages.

* cited by examiner

MANUAL CALL POINT

FOREIGN PRIORITY

This application claims priority to European Patent Application No. 19213175.3, filed Dec. 3, 2019, and all the benefits accruing therefrom under 35 U.S.C. § 119, the contents of which in its entirety are herein incorporated by reference.

TECHNICAL FIELD

The present invention relates to a manual call point for a fire alarm system, and to a related method of activating a manual call point for a fire alarm system.

BACKGROUND

In many jurisdictions fire alarm systems are provided with manual call points allowing for manual fire alarm activation via human intervention. Typically some form of electromechanical device is used allowing for a person to sound an alarm, such as an evacuation alarm in a building. Often these manual call points are used in conjunction with automatic fire alarm systems in which there is a possibility for automatic activation using sensors such as heat detectors and smoke detectors. Automated fire suppression systems can be provided within the same system. The manual call points can be wired into the fire alarm system or in some cases may be wirelessly connected.

As the manual call points are an important safety feature then it is typical for regulations to set requirements for their appearance, operation and placement, as well as setting out methods of testing to ensure that call points have the required performance before they are placed on the market. For example, European Standard EN 54 part 11 specifies the requirements and methods of test for manual call points in fire detection and fire alarm systems in and around buildings. This European Standard contains provisions similar to those in other jurisdictions where manual call points are used, defining different required elements of the manual call point as well as how they should function.

Within this document the following terminology is used, which is consistent with the terminology of EN 54-11 for the sake of convenience. It will be appreciated that the terms used should apply in the same way to equivalent structural and functional elements of manual call points intended for operation in other jurisdictions, i.e. meeting alternative regulatory requirements where the terminology may differ.

As referenced herein, an alarm condition is the condition of the manual call point after an operating element thereof has been activated. The operating element is a mechanical and electrical switching element; the part of the manual call point that initiates the alarm signal when operated. Typical manual call points also include a frangible element, which is a component made of glass or having the appearance of glass (e.g. "plastic glass") and which after receiving a blow or pressure, is physically broken or is visibly displaced by change of position and remains in that condition until replaced or reset. The frangible element gives protection against unintentional operation, i.e. by resisting relatively small forces, and is a deterrent against misuse. The breaking or apparent breaking (e.g. visible displacement) of the frangible element is designed to be necessary in order to activate the operating element, which typically includes a part visible to the user through the frangible element.

Manual call points can be provided with a non-resettable frangible element, i.e. a frangible element that needs to be replaced after the activation of the manual call point, in order for the manual call point to be able to return to a normal condition. Alternatively there may be a resettable frangible element that can be returned to its original position without replacement, in order for the manual call point to be able to return to the normal condition also without replacement of the frangible element. The normal condition is a condition in which the frangible element is undamaged and the manual call point is operating without giving an alarm or fault signal.

Manual call points are divided into two types depending on the method of operation, with EN 54-11 denoting these as type A: direct operation, and type B: indirect operation. A direct operation manual call point is a device in which the change to the alarm condition is automatic (i.e. without the need for further manual action) when the frangible element is broken or displaced. An indirect operation manual call point is a device in which the change to the alarm condition requires a separate manual operation of the operating element by the user after the frangible element is broken or displaced, e.g. where breaking the frangible element gives access to the operating element.

As noted above, the alarm condition is the condition after activation of the operating element. Typically the transfer from the normal condition to the alarm condition is easily recognisable by the change in the appearance of the operating face, such as by the breakage or apparent breakage of the frangible element and/or by movement of the operating element. For indirectly operated call points it is also required by EN 54-11 that in the alarm condition it shall be possible to see that the operating element is in the activated position and it shall not be possible to activate the operating element without breaking or displacing the frangible element (unless with the use of a special tool, e.g. a key used for testing the device).

In existing manual call points the operating element is often an electromechanical switch device such as a microswitch or other switch device in which physical movement of the operating element brings electrical contacts into or out of engagement.

SUMMARY

Viewed from a first aspect, the present invention provides a manual call point for a fire alarm system, the manual call point comprising: an operating element, wherein a physical movement of the operating element will trigger an alarm condition of the manual call point; and at least two switch devices, with each switch device being for completing or breaking a circuit in response to the physical movement of the operating element; wherein at least one of the switch devices is a contactless device and the corresponding circuit includes an electromagnetic circuit that is completed or broken without mechanical contact from the operating element.

With this manual call point advantages are provided in relation to increased reliability and a reduced requirement for testing of the operation of the call point. The use of a contactless switch using an electromagnetic circuit avoids many failure modes that affect prior art designs relying solely on an electromechanical switch, such as corrosion of the electrical contacts. The contactless switch can be arranged to be normally open or normally closed, with the state of the switch changing in response to activation of the operating element, i.e. in response to the physical movement thereof (but without mechanical contact). Moreover, as discussed in more detail below, a contactless switch can allow for the possibility of self-verification, whereby the call point can confirm the continued operation of the electromagnetic circuit without the need for manual triggering of the operating element to test the functioning of the call point. The activation of the alarm condition of the call point may rely on any one switch changing state, thereby increasing reliability by providing redundancy in the event of a failure of a switch. Also, if an activation of the alarm condition is triggered with fewer than all of the switches changing state then this can be used as an alert indicating a possible failure, so that the manual call point can be inspected and, if needed, repaired or replaced.

In some implementations, the at least two switch elements include the contactless switch and an electromechanical switch. The electromechanical switch may include a microswitch, for example. In that case the call point will include one electromagnetic circuit with a switch that completes or breaks the circuit without mechanical contact with the operation element and one electromechanical switch that completes or breaks an electrical circuit via mechanical contact with the operating element, such as via forces from the operating element on a physical contact mechanism of the electromechanical switch. This means that the call point has redundancy via two different forms of switch device having quite different failure modes, which increases reliability. Failure modes relating to degradation or interference that have a significant risk to the electromechanical switch, such as corrosion from moisture, are not likely to generate the same level of risk to the electromagnetic switch. Similarly, failure modes relating to degradation or interference that have a significant risk to the electromagnetic switch, such as electromagnetic interference, are not likely to generate the same level of risk to the electromechanical switch. The electromechanical switch can be arranged to be normally open or normally closed, with the state of the switch changing in response to activation of the operating element, i.e. in response to the physical movement thereof.

Alternatively or additionally, the at least two switch elements may include the contactless switch and a further contactless switch. The two contactless switches may operate using the same principles and optionally also may use similar (or identical) components. This can simplify the construction of the call point. For example, the two contactless switches may both be optical switches, or some other type of contactless switch as discussed further below. The two contactless switches may include a contactless switch that is arranged to be normally closed and a contactless switch that is arranged to be normally open. Thus, the alarm condition may be triggered by opening of the normally close contactless switch or by closing of the normally open contactless switch. This acts as a fail-safe arrangement as well as enhancing the capabilities of the call point with respect to self-verification procedures. It will be appreciated that the state of the normally closed and normally open switches can be checked without activation of the operating element, with the ability to confirm that some aspects of the call point are operating effectively simply by checking the status of the two contactless switches and their respective electromagnetic circuits.

In example embodiments the manual call point comprises at least three switches, or only three switches, wherein the switches include first and second contactless switches along with an electromechanical switch. This allows for all of the various advantages discussed above to be combined, with enhanced capabilities for self-verification as well as increased reliability due to the presence of differing failure modes.

Various possible forms of contactless switch may be used for the contactless switch(es) of the at least two switches. For example, the contactless switch(es) may comprise optical switches, magnetic switches, radar devices, proximity sensors and so on. Suitable magnetic switches include switches using hall sensors. The contactless switch(es) may be provided by electromagnetic circuits comprising paired emitter and receiver components, such as optical emitter and receiver components. Photodiodes may be used as optical receiver components. The optical emitters may for example be lasers or lamps. In example embodiments the contactless switch(es) comprise a light emitting diode paired with a photodiode. It will be appreciated that this allows for a reliable low power arrangement for both normally open and normally closed arrangements.

The receiver and emitter components of the contactless switch(es) may be placed either side of a working path for the operating element, i.e. either side of a location occupied by the operating element during the normal condition or the alarm condition. The operating element may hence block the passage of electromagnetic radiation between the receiver and emitter components in order to change the state of the switch. In some example embodiments two or more contactless switches may share a common emitter component. For instance a manual call point may include one emitter component and two receiver components, with electromagnetic radiation passing from the one emitter to both the first and second receiver to form two contactless switches. The receiver components act to complete or break the circuit depending on the electromagnetic radiation received (or not received) from the common emitter. Alternatively, each receiver component may have a dedicated emitter component, such that each switch has both of an emitter component and a receiver component.

In example embodiments using two contactless switches with each having a respective emitter component (and a respective receiver component) an emitter component of one contactless switch may be placed on a first side of the operating element alongside a receiver component of the other contactless switch, with the receiver component of the one contactless switch being placed on a second side of the operating element alongside an emitter component of the other contactless switch. Thus, the respective emitters and receivers are diagonally apart from one another. This can facilitate a self-verification procedure such as that discussed below, since there is a potentially easier route for electromagnetic radiation such as light to pass from the emitter of one switch to the receiver of the other switch.

Advantageously, where two similar contactless switches are used, the call point or an associated external controller may be arranged to assess the interaction between components of the two contactless switches as a part of a self-verification procedure. Thus, the self-verification may include steps for cross-checking the operation of the two contactless switches, such as by using a receiver component of one switch to check the operation of an emitter component of the other switch. Since both the contactless switches will be housed within the same call point device, which generally has a restricted size, such as that defined by EN 54-11, then they will be in relatively close proximity and the underlying electromagnetic principles may allow for the assessment of the effect of adjacent switching components. For example, in the case of optical switches such as the light emitting diode and photodiode combination mentioned above, then the optical receiver component of one contactless switch may detect some of the light emitted by the optical emitter component of the other contactless switch, such as via visible light reflected and/or scattered within the call point. Similar effects may be present for other electromagnetic components, such as magnetic sensing devices.

A self-verification procedure for the call point may include detecting the condition of the normally closed contactless switch by sensing the interaction of the components of that switch via a receiver component of the normally closed contactless switch, and also detecting the condition of an emitter component of the normally open contactless switch via the same receiving component of the normally closed contactless switch. This can hence check that the emitter component of the normally open switch is operating, without the need to activate, i.e. physically move, the operating element. The self-verification procedure may alternatively or additionally comprise sensing the interaction of the components of the normally closed contactless switch via a receiver component of the normally closed contactless switch, and also detecting the condition of an emitter component of the normally closed contactless switch via the receiving component of the normally open contactless switch. This can check that the receiver component of the normally open contactless switch is operating, without the need to close the switch by activating the operating element.

The call point may include a controller, such as a microprocessor, for interaction with the switches during operation of the call point and/or for performing a self-verification procedure, such as a procedure discussed above. Alternatively or additionally the call point may be arranged for communication with an external controller for interaction with the switches during operation of the call point and/or for performing the self-verification procedure for the switches. The call point may be configured for wired and/or wireless communication with an external alarm system, which may comprise the external controller. The controller may be arranged to assess if an activation of the alarm condition is triggered with fewer than all of the switches changing state and, if so, to provide an alert indicating a possible failure. This allows for the manual call point to be inspected and, if needed, repaired or replaced in order to ensure that all of the switches, e.g. the two or three switches as discussed above, are operating correctly.

The operating element may include a mechanical component arranged for physical movement to trigger the alarm condition, wherein the mechanical component includes a section that will open or close the contactless switch(es). Thus, in the case of an optical switch or other line-of-sight electromagnetic switch the mechanical component may include a section that is opaque for the respective wavelength of electromagnetic radiation, e.g. opaque to light from light emitting diodes if used for an optical switch. In the case of other forms of switch the mechanical component may include a section that will trigger operation of the switch, such as a magnetic material to trigger a magnetic sensor.

The manual call point may include a frangible element that is arranged to break or displace during user interaction with the call point to trigger the alarm condition. The frangible element may for example be as discussed in EN 54-11. The frangible element may comprise a transparent element shielding the operating element.

In example embodiments a physical force is required to activate the operating element, such as a force applied by the user to physically move the operating element. Advantageously, the manual call point is able to withstand relatively small forces and/or impacts, with a force and/or impact larger than a threshold being needed to activate the operating element, and optionally also break or displace the frangible element if present. For example, the call point may be arranged to meet the requirements of EN 54-11 with respect to non-activation for a relatively small force. Thus, the call point may be arranged such that it does not activate the alarm condition when tested by a force applied perpendicular to the frangible element increasing at a rate not exceeding 5 Ns−1 until it reaches (22.5±2.5) N, maintained for 5 s then released at a rate not exceeding 5 Ns−1. Further, the call point may be arranged such that after this relatively small force is applied to the frangible element without operation the call point is still able to operate when an appropriate force is applied to the frangible element by the user, such as a force as imparted by the relevant test defined in EN 54-11.

Where a frangible element is used then breaking or displacing the frangible element may directly trigger activation of the operating element, such as by effecting the physical movement thereof. In the alternative, the call point may be arranged for indirect operation, where the frangible element must be broken and or displaced to access the operating element, with a separate manual activation of the operating element being required to trigger the alarm condition.

The manual call point may have a size and shape consistent with the requirements of applicable regulations. For example, the size and shape may be as required by EN 54-11. Thus, the manual call point may have a cuboid housing with a rectangular front face, such as a square front face with the housing comprising an outer wall enclosing all parts of the manual call point. The housing may be arranged to mount to a flat vertical surface, e.g. a wall of a building, with the front face sitting forward of the vertical surface by at least 10 mm or at least 15 mm. The operating element may be accessible and/or visible through the front face, such as through a window that may be provided by the frangible element. The front face may have a height and/or width be in the range 85 mm to 135 mm.

Viewed from a second aspect, the invention provides a method of use of a manual call point as described above in relation to the first aspect. The manual call point may include any other feature as discussed above.

The method may include operating the manual call point, wherein the method comprises triggering an alarm condition by physical movement of the operating element to change the state of at least one of the switches. The alarm condition may be triggered when any one of the switches changes state from its normal condition, such as by changing from normally closed to open or by changing from normally open to closed.

The method may include self-verification by the manual call point, wherein the self-verification includes steps to confirm that at least one of the switches is operational without activation of the operating element. The self-verification procedures, in the case of two contactless switches such as two optical switches, may include cross-checking the operation of the contactless switches via interaction between components of the two switches as discussed above. The method may include repeating the self-verification procedures periodically, for example as a part of a self-checking routine.

Thus, where a normally closed and a normally open contactless switch are used together then the method may include detecting the condition of the normally closed contactless switch by sensing the interaction of the components of that switch via a receiver component of the normally closed contactless switch, and also detecting the condition of an emitter component of the normally open contactless switch via the same receiving component of the normally closed contactless switch. The method may alternatively or additionally comprise sensing the interaction of the components of the normally closed contactless switch via a receiver component of the normally closed contactless switch, and also detecting the condition of an emitter component of the normally closed contactless switch via the receiving component of the normally open contactless switch.

Viewed from a third aspect, the invention provides a manual call point for a fire alarm system, the manual call point comprising: an operating element, wherein a physical movement of the operating element will trigger an alarm condition of the manual call point; and at least two switch devices, with each switch device being for completing or breaking a circuit in response to the physical movement of the operating element; wherein at least one of the switch devices is a contactless switch and the corresponding circuit includes an electromagnetic circuit that is completed or broken without mechanical contact from the operating element; wherein the at least two switch devices include the contactless switch and a further contactless switch, wherein the two contactless switches include a contactless optical switch that is arranged to be normally closed and a contactless optical switch that is arranged to be normally open; wherein an emitter component of one contactless optical switch is placed on a first side of the operating element alongside a receiver component of the other contactless optical switch, with the receiver component of the one contactless optical switch being placed on a second side of the operating element alongside an emitter component of the other contactless optical switch; and wherein the call point or an associated external controller is arranged to assess the interaction between components of the two contactless optical switches as a part of a self-verification procedure, and wherein the self-verification includes steps for cross-checking the operation of the two contactless optical switches, by using a receiver component of one contactless optical switch to check the operation of an emitter component of the other contactless optical switch.

BRIEF DESCRIPTION OF THE DRAWINGS

Certain preferred embodiments of the present invention will now be described, by way of example only, with reference to the following drawings, in which.

DETAILED DESCRIPTION

Figure 2:
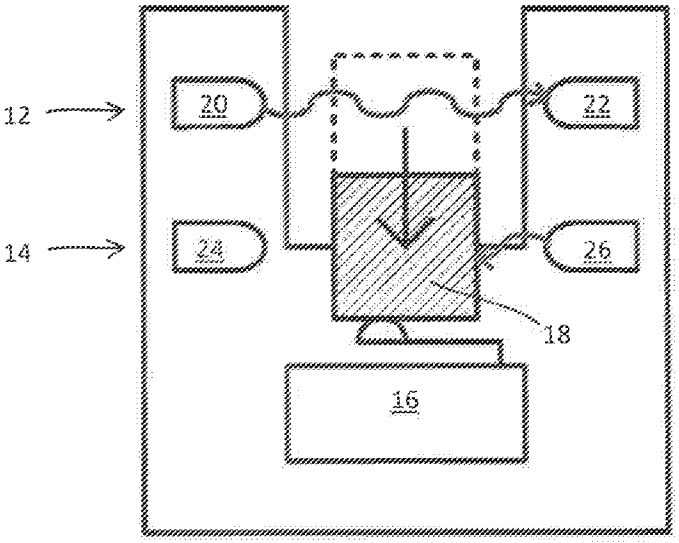
FIG. 2 is a diagram of the manual call point after activation of an operating element to trigger an alarm condition.
Figure 1:
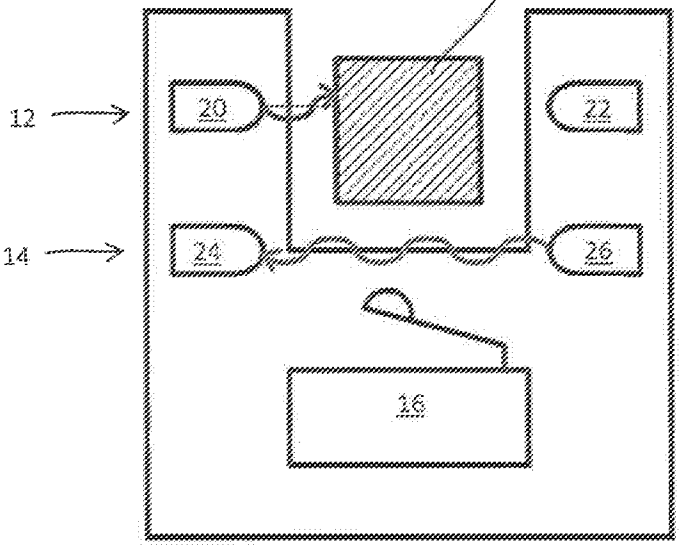
FIG. 1 is a diagram of a manual call point in a normal condition.

As shown in the Figures a manual call point includes a body 10 housing switches 12, 14, 16 and an operating element 18. The switches 12, 14, 16 include two contactless switches 12, 14 and an electromechanical switch 16. The electromechanical switch 16 can include a micro switch, for example. The contactless switches 12, 14 are advantageously similar or identical switches, using the same operating principle and similar components. This reduces the number of differing parts required as well as enhancing the ability of the call point to perform a self-verification process as discussed further below. The operating element 18 is a mechanical component that physically moves when the manual call point is activated and enters an alarm condition. FIG. 1 shows the operating element 18 with the manual call point in the normal condition, i.e. with no alarm. FIG. 2 shows the state after activation of the manual call point by movement of the operating element 18, which in this case will change the state of the electromechanical switch 16 by mechanical contact, as well as changing the state of the two contactless switches 12, 14 due to a change in the influence of the operating element 18 on those switches 12, 14.

The contactless switches 12, 14 may be implemented in various ways such as with differing types of electromagnetic switches as discussed above. The influence of the operating element 18 on the contactless switches 12, 14 can hence vary accordingly, e.g. via influence on the relevant electromagnetic circuit. In this example the contactless switches 12, 14 are optical switches using light emitting diodes (LEDs) and light sensors in the form of photodiodes. The first contactless switch 12 includes an optical circuit with a first LED 20 and a first photodiode 22. The second contactless switch 14 includes an optical circuit with a second LED 26 and a second photodiode 24.

As shown, the first contactless switch 12 is normally open, i.e. it is open in the normal condition of the manual call point with the operating element 18 in the position shown in FIG. 1, whereas the second contactless switch 14 is normally closed. Thus, in the normal condition of FIG. 1 light can pass from the second LED 26 with a direct line of sight 28 to the second photodiode 24, whereas the operating element 18, which is opaque to the relevant wavelengths, blocks the passage of light from the first LED 20 to the first photodiode 22. If the operating element 18 is activated, which in this example involves moving from the position of FIG. 1 to that of FIG. 2, then along with the mechanical contact that changes the state of the electromechanical switch 16, there is also a change in the influence of the operating element 18 since the line of sight for light from the second LED 26 to the second photodiode 24 is blocked, whereas a line of sight 30 from the first LED 20 to the first photodiode 22 is opened. The normally closed switch becomes open and the normally open switch becomes closed.

The activation of the alarm condition can rely on any one switch changing state, thereby increasing reliability by providing redundancy in the event of a failure of a switch. Also, if an activation of the alarm condition is triggered with fewer than all three switches changing state then this can be used as an alert indicating a possible failure, so that the manual call point can be inspected and, if needed, repaired or replaced.

The operating element 18 is some mechanical device activated by user interaction, such as a sliding or hinged actuating piece. The manual call point may also include a frangible element (not shown) such as a frangible element of the type described in EN 54-11. In that case the operating element 18 can be directly operated via breakage or displacement of the frangible element, or indirectly operated by user interaction once breakage or displacement of the frangible element gives access to the operating element 18. Other features of the manual call point, such as the size and form of the housing 10 may be provided in accordance with applicable regulatory requirements, such as regulations in line with EN 54-11. The manual call point may be configured for wired and/or wireless connectivity, such as to be connected with an alarm system of a building.

The manual call point can perform a self-verification procedure in order to determine if at least one of the contactless switches 12, 14 is functional without the need to activate the operating element 18. This gives an advantage over traditional electromechanical devices where physically movement of the operating element 18 is necessary to test the device, and hence a person must be physically present. With the ability to perform self-verification it becomes possible to remotely check at least some aspects of the device function, e.g. checking the contactless switches 12, 14 even if the electromagnetic switch 16 can only be tested with physical presence and movement of the operating element 18. The self-verification procedure may be performed via controller, such as a microprocessor, which may be a controller provided as a part of the manual call point or an external controller, which may for example be an alarm system of a building.

To aid and enhance the self-verification capability the receiver and emitter components of the two contactless switches 12, 14 are placed either side of a working path for the operating element with the respective emitter components (LEDs 20, 26 in this example) and receiver components (photodiodes 22, 24 in this example) being diagonally apart from one another. The working path comprises the locations occupied by the operating element 18 during the normal condition or the alarm condition. The operating element 18 hence block or permit the passage of electromagnetic radiation between the receiver and emitter components in order to change the state of the contactless switches 12, 14. As seen in the Figures, the LED 20 of the first contactless switch 12 is placed on a first side of the operating element 18 alongside the photodiode 24 of the second contactless switch 14, with the photodiode 22 of the first contactless switch 12 being placed on a second side of the operating element 18 alongside the LED 26 the second contactless switch 14.

The self-verification procedures include cross-checking the operation of the contactless switches 12, 14 via interaction between the LEDs 20, 26 and photodiodes 22, 24. The condition of the first LED 20 of the normally open first contactless switch 12 is checked by using the photodiode 24 of the second contactless switch 14 to detect light from the first LED 20. This can be aided by switching off the second LED 26, or by the use of LEDs with different wavelengths. The condition of the first photodiode 22 of the normally open first contactless switch 12 is checked by detecting light from the second LED 26. These steps also check the condition of the second LED 26 and second photodiode 24, with a further check being possible by straightforward confirmation that this second, normally closed, contactless switch 14 is indeed a closed switch, with the second photodiode 24 detecting light from the second LED 26 when it is illuminated, but not when it is not illuminated. It will be understood that the steps required for these self-verification procedures can be carried out automatically, without the need for any human intervention, including under the control of some remote system.

In some implementations, the emitter components such as the LEDs 20, 26 may emit pulses rather than being constantly illuminated. With the use of constant illumination or with pulses the manual call point may include a suitable circuit, optionally with a microprocessor as noted above, for controlling the illumination of the emitter components and for providing appropriate signals based on the output of the receiver components. For example, with LEDs 20, 26 and photodiodes 22, 24 as in the Figures, the light collected by the photodiodes 22, 24 is electrically converted into a detection signal, which can be fed into an amplifier circuit that generates an amplified analog output signal. The analog amplified output signal can be converted to an output digital signal with an analog-to-digital converter and communicated to an evaluation module. In some examples, the evaluation module is part of the controller discussed above. The evaluation module can be provided with software that includes comparison algorithms for verifying the optical and electrical integrity of the call point by comparing the electric output of the switches with a predefined and verified output. This verification is based on software analysis in the controller.

Figure 3:
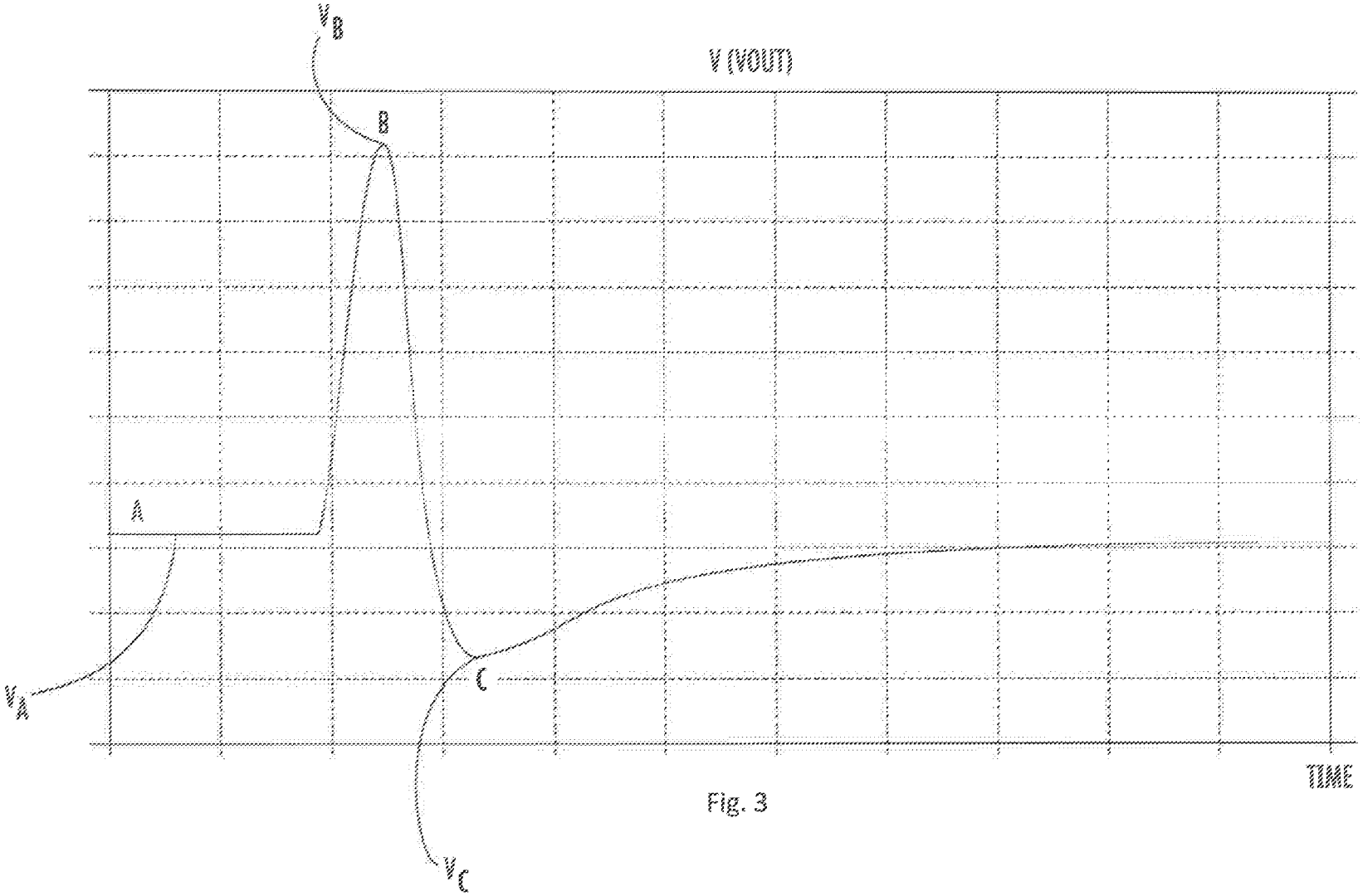
FIG. 3 is a plot of an output signal for an example contactless switch.

Referring now to FIG. 3, a time response plot is illustrated with the output digital signal from a photodiode shown as a function of time. The output digital signal is ultimately a function of the light received at the photodiode, which in this case is a light pulse such as from the respective LED. A nominal background signal is represented by A on the plot. In a simple case, for example with reference to FIG. 1 and considering the background signal for the normally closed contactless switch 14 the nominal background signal is present when the LEDs 20, 26 are inactive (e.g., off) then the plot for the output signal of the second photodiode 24 may vary as follows. When the second LED 26 becomes active (e.g., turned on), the output digital signal will increase to reach a maximum signal value that is represented by B on the plot. When the second LED 26 is switched off, the signal value will undershoot below the nominal signal A to a minimum signal value that is represented by C on the plot before it settles up to the nominal background signal A again. Alternatively, the nominal background signal may be present with the LED 26 active (e.g., on), and hence the level A may be somewhat higher than shown in FIG. 3. When the LED 26 then becomes inactive (e.g., off), the output digital signal will adjust to reach the minimum signal value C. When the LED is switched back on, the signal value will adjust to the maximum signal value B and overshoot the background level before it settles down to the nominal background signal A again. Therefore, it is the extreme values that are of significance, not necessarily the order in which the data is taken.

It will be appreciated that with the arrangement of LEDs 20, 26 and photodiodes 22, 24 in the current example then as noted above the LED of the one contactless switch can have a secondary effect on the light received at the photodiode of the other contactless switch. Thus, there could be further plots of similar shape but lower extremes where, for example, the first LED 20 can lead to changes in the signal level from the second photodiode 24. Moreover, yet further plots would exist taking account of a background level with both LEDs 20, 26 active, and then just one or both LEDs 20, 26 changing state. The various possible plots each have measured signals A, B, C with expected values and this can be used to determine acceptable operational ranges within which a self-verification procedure will confirm that the two contactless switches 12, 14 are working correctly. The acceptable operational ranges can be based on theoretically determined values which are then experimentally refined.

In an example implementation, the signal is plotted with voltage values and the nominal voltage VA should be between allowed values Vnom_min and Vnom_max. This verifies the offset voltage for the amplifier, that there is no ambient light leaking into the chamber, and that the amplifier is functioning properly. VA may drift for multiple possible reasons. For example, natural temperature effects may impact the signal and are acceptable within a limit. Light leakage detrimentally impacts the overall operation of the manual call point (when using optical sensing) and is not deemed acceptable. Amplifier and/or sensor failure is also not deemed acceptable.

The comparison made by the evaluation module can focus on a ratio of differences of the measured signals. In particular, the following ratio is calculated: (VB−VA)/(VA−VC). This ratio is constant within a tolerance. This measure verifies the filter components in the amplifier circuitry. The measure is valid as long as the output is within amplifier saturation limits.

There are alternative methods of determining the validity of the received light/signals. For example, a burst of analog to digital conversions can be made throughout the pulse, with the sum, or sum of squares, of the samples being calculated to determine the magnitude of the received signal. Additionally, the expected pulse can be stored in the memory of the controller. The measured pulse is then multiplied with a factor that is the ratio between the magnitude of the stored and measured pulse. After this multiplication (normalization), the measured waveform, and the difference must be below a predefined limit. In addition to one or more of the features described above, or as an alternative, the cross-correlation between the stored and measured pulse must be above a certain limit.

Advantageously, comparing the ratio of differences provides detection light source/sensor failure, detection of amplifier failure or erroneous components in the amplifier circuitry. All detection and verification is done with software, thereby allowing for local or remote control of the process.

It will be understood that some features described herein, such as a frangible element, are required by regulation such as with reference to EN54-11, and of course all such features for must be included for devices intended to be approved under those regulations. However, it should be appreciated that it is not essential to the function of the call point described herein, and in particular the function of the operating element and switches, for all such features to be present. Moreover, whilst all features defined in the relevant regulations are in effect essential for a commercial product, this is not the same as what is essential for implementing the present claims. Instead the claims themselves define what is essential in that regard, taking account of the teaching of the remainder of this disclosure.

What is claimed is:

1. A method of use of a manual call point for a fire alarm system, the manual call point comprising: an operating element, wherein a physical movement of the operating element will trigger an alarm condition of the manual call point; and at least two switch devices, with each switch device being for completing or breaking a circuit in response to the physical movement of the operating element; wherein at least one of the switch devices is a contactless switch and the corresponding circuit includes an electromagnetic circuit that is completed or broken without mechanical contact from the operating element wherein the contactless switch is provided by electromagnetic circuits comprising a light emitting diode paired with a photodiode;

the method comprising at least one of: operating the manual call point by triggering the alarm condition by physical movement of the operating element to change the state of at least one of the switch devices; and self-verification by the manual call point;

wherein the self-verification includes steps to confirm that at least one of the switch devices is operational without activation of the operating element;

wherein the at least two switch devices include the contactless switch and a further contactless switch; and wherein the self-verification includes steps for cross-checking the operation of the two contactless switches, by using a receiver component of one switch to check the operation of an emitter component of the other switch.

2. A manual call point for a fire alarm system, the manual call point comprising:

an operating element, wherein a physical movement of the operating element will trigger an alarm condition of the manual call point; and at least two switch devices, with each switch device being for completing or breaking a circuit in response to the physical movement of the operating element;

wherein at least one of the switch devices is a contactless switch and the corresponding circuit includes an electromagnetic circuit that is completed or broken without mechanical contact from the operating element;

wherein the at least two switch devices include the contactless switch and a further contactless switch, wherein the two contactless switches include a contactless optical switch that is arranged to be normally closed and a contactless optical switch that is arranged to be normally open;

wherein an emitter component of one contactless optical switch is placed on a first side of the operating element alongside a receiver component of the other contactless optical switch, with the receiver component of the one contactless optical switch being placed on a second side of the operating element alongside an emitter component of the other contactless optical switch; and wherein the call point or an associated external controller is arranged to assess the interaction between components of the two contactless optical switches as a part of a self-verification procedure, and wherein the self-verification includes steps for cross-checking the operation of the two contactless optical switches, by using a receiver component of one contactless optical switch to check the operation of an emitter component of the other contactless optical switch.

* * * * *